US005099644A

United States Patent [19]

Sabla et al.

[11] Patent Number: 5,099,644

[45] Date of Patent: Mar. 31, 1992

[54] LEAN STAGED COMBUSTION ASSEMBLY

[75] Inventors: Paul E. Sabla, Cincinnati; Willard J. Dodds, West Chester; Thomas M. Tucker, Cincinnati, all of Ohio

[73] Assignee: General Electric Company, Cincinnati, Ohio

[21] Appl. No.: 504,365

[22] Filed: Apr. 4, 1990

[51] Int. Cl.[5] ..... F02C 3/04; F23R 3/34

[52] U.S. Cl. ..... 60/267; 60/733; 60/749

[58] Field of Search ..... 60/733, 739, 749, 751, 60/261, 241, 267, 748

[56] References Cited

U.S. PATENT DOCUMENTS

| | | | |
|---|---|---|---|
| 2,693,083 | 11/1954 | Abbott | 60/749 |
| 2,823,519 | 2/1958 | Spalding | 60/39.71 |
| 2,872,785 | 2/1959 | Barrett et al. | 60/749 |
| 2,993,338 | 7/1961 | Wilsted | 60/39.74 |
| 3,149,463 | 9/1964 | Withers et al. | 60/39.74 |
| 3,176,465 | 4/1965 | Colley, Jr. | 60/749 |
| 3,288,447 | 11/1966 | Withers et al. | 261/69 |
| 3,307,355 | 3/1967 | Bahr | 60/39.71 |
| 3,877,863 | 4/1975 | Penny | 431/75 |
| 3,981,675 | 9/1976 | Szetela | 431/175 |
| 4,052,844 | 10/1977 | Carvel et al. | 60/733 |
| 4,292,801 | 10/1981 | Wilkes et al. | 60/39.06 |
| 4,305,255 | 12/1981 | Davies et al. | 60/741 |

FOREIGN PATENT DOCUMENTS

| | | |
|---|---|---|
| 0222173 | 5/1987 | European Pat. Off. . |
| 2146325 | 4/1985 | United Kingdom . |

OTHER PUBLICATIONS

Lefebvre, Arthur H. *Gas Turbine Combustion*, McGraw-Hill, New York, 1983, pp. 463-509.

Markowski, S. J. et al., "The Vorbix Burner-A New Approach to Gas Turbine Combustors" *Journal of Engineering Power* Jan. 1976, pp. 123-129.

*Primary Examiner*—Richard A. Bertsch
*Assistant Examiner*—Timothy S. Thorpe
*Attorney, Agent, or Firm*—Jerome C. Squillaro

[57] ABSTRACT

A combustion assembly includes a combustor having inner and outer liners, and pilot stage and main stage combustion means disposed between the liners. A turbine nozzle is joined to downstream ends of the combustor inner and outer liners and the main stage combustion means is close-coupled to the turbine nozzle for obtaining short combustion residence time of main stage combustion gases for reducing $NO_x$ emissions. In a preferred and exemplary embodiment of the invention, the combustion assembly includes first and second pluralities of circumferentially spaced fuel injectors and air swirlers disposed radially outwardly of a plurality of circumferentially spaced hollow flameholders having fuel discharge holes. Pilot stage combustion is effected downstream of the first and second fuel injectors and swirlers, and main stage combustion is effected downstream of the flameholders. The flameholders are disposed downstream of the first and second fuel ejectors and swirlers and close-coupled to the turbine nozzle for obtaining the short combustion residence time.

19 Claims, 2 Drawing Sheets

Fig. 1.
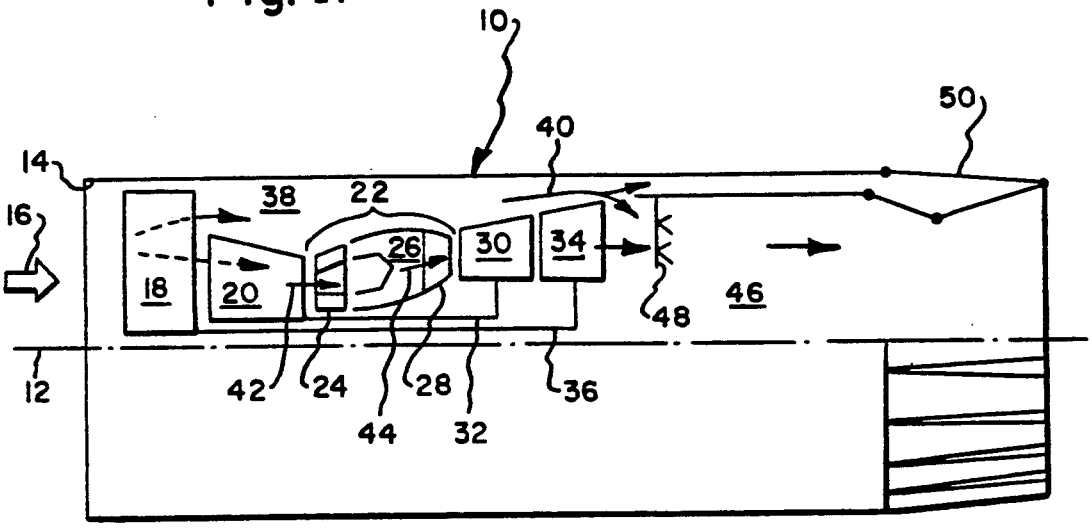
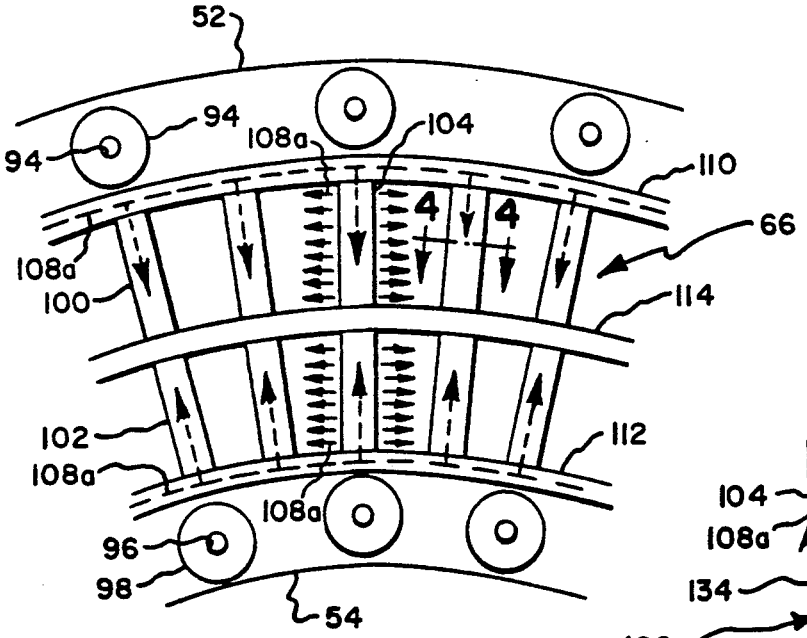
Fig. 3.
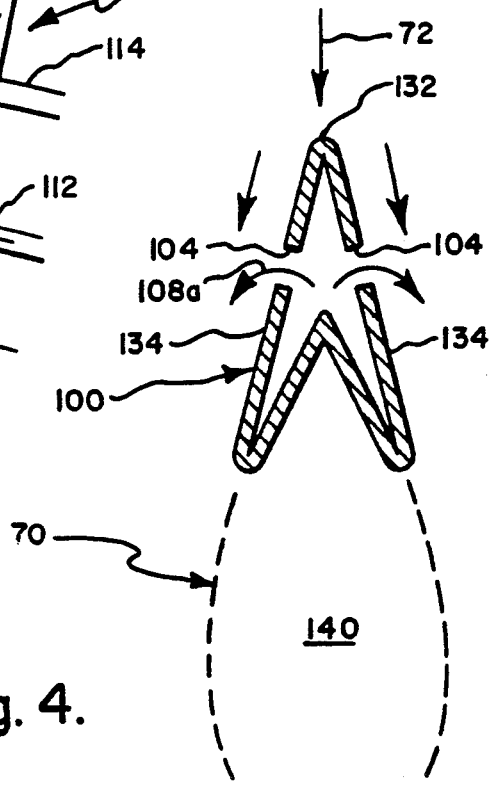
Fig. 4.

22
28
52b
52
128
120
116
64
108a
118
52a
124
108
122
108
126
138
108
42
42
76
20
24
78
80
82
72
62
62
92
94
56
106
58
84
84a
84b
60
86
110
100a
68
100
104
114
100b
102b
26
66
104
68
102
102a
112
90
88b
88
88a
58
60
108a
106
56
98
96
108a
116
54a
54
54b
136
70
74
44
130
30
3
3

LEAN STAGED COMBUSTION ASSEMBLY

TECHNICAL FIELD

The present invention relates generally to gas turbine engines, and, more specifically, to a combustion assembly effective for reducing $NO_x$ emissions.

BACKGROUND ART

Commerical, or civil, aircraft are conventionally designed for reducing exhaust emissions from combustion of hydrocarbon fuels such as, for example, Jet A fuel. The exhaust emissions may include hydrocarbon particulate matter, in the form of smoke, for example, carbon monoxide, and nitrogen oxides ($NO_x$) such as, for example, nitrogen dioxide $NO_2$. $NO_x$ emissions are known to occur from combustion at relatively high temperatures, for example over 3000° F. (1648° C.). These temperatures occur when fuel is burned at fuel-air ratios at or near stoichiometric. The amount of emissions formed is directly related to the time that combustion takes place at these conditions.

Conventional gas turbine engine combustors for use in an engine for powering an aircraft are conventionally sized and configured for obtaining varying fuel/air ratios during the varying power output requirements of the engine such as, for example, during light-off, idle, takeoff, and cruise modes of operation of the engine in the aircraft. At relatively low power modes, such as at light-off and idle, a relatively rich fuel/air ratio is desired for initiating combustion and maintaining stability of the combustion. At relatively high power modes, such as for example cruise operation of the engine in the aircraft, a relatively lean fuel/air ratio is desired for obtaining reduced exhaust emissions.

In the cruise mode, for example, where an aircraft gas turbine operates for a substantial amount of time, conventional combustors are typically sized for obtaining combustion at generally stoichiometric fuel/air ratios in the dome region, which represents theoretically complete combustion. However, in practical applications, exhaust emissions nevertheless occur, and conventional combustors utilize various means for reducing exhaust emissions.

Furthermore, aircraft intended to be operated at relatively high speed and at high altitude require engines having higher performance and power output. This may be accomplished by increasing the operating temperature of the engine cycle. These higher cycle temperatures will result in higher combustion zone temperatures and a higher $NO_x$ emissions formation rate. Therefore, in a conventional engine, $NO_x$ levels will increase which is especially undesirable at high altitudes for its potential damage to the ozone layer.

OBJECTS OF THE INVENTION

Accordingly, one object of the present invention is to provide a new and improved combustion assembly for an aircraft gas turbine engine.

Another object of the present invention is to provide a combustion assembly effective for reducing $NO_x$ emissions.

Another object of the present invention is to provide a combustion assembly effective for operating over a broad range of engine power conditions.

Another object of the present invention is to provide a combustion assembly which is relatively short and lightweight.

Another object of the present invention is to provide a combustion assembly having means for controlling the profile of combustion gases discharged from a combustor.

DISCLOSURE OF INVENTION

A combustion assembly includes a combustor having inner and outer liners, and pilot stage and main stage combustion means disposed between the liners. A turbine nozzle is joined to downstream ends of the combustor inner and outer liners and the main stage combustion means is close-coupled to the turbine nozzle for obtaining short combustion residence time of main stage combustion gases for reducing $NO_x$ emissions. In a preferred and exemplary embodiment of the invention, the combustion assembly includes first and second pluralities of circumferentially spaced fuel injectors and air swirlers disposed radially outwardly of a plurality of circumferentially spaced hollow flameholders having fuel discharge holes. Pilot stage combustion is effected downstream of the first and second fuel injectors and swirlers, and main stage combustion is effected downstream of the flameholders. The flameholders are disposed downstream of the first and second fuel injectors and swirlers and close-coupled to the turbine nozzle for obtaining the short combustion residence time.

BRIEF DESCRIPTION OF THE DRAWINGS

The novel features believed characteristic of the invention are set forth and differentiated in the claims. The invention, in accordance with a preferred, exemplary embodiment, together with further objects and advantages thereof, is more particularly described in the following detailed description taken in conjunction with the accompanying drawing in which:

FIG. 1 is schematic representation of an augmented, turbofan, gas turbine engine for powering an aircraft.

FIG. 3 is a schematic upstream facing end view of a portion of the combustion assembly illustrated in FIG. 2 taken along line 3—3.

FIG. 4 is a transverse sectional view taken through one of the flameholders illustrated in FIG. 3 taken along line 4—4.

MODE(S) FOR CARRYING OUT THE INVENTION

Figure 2:
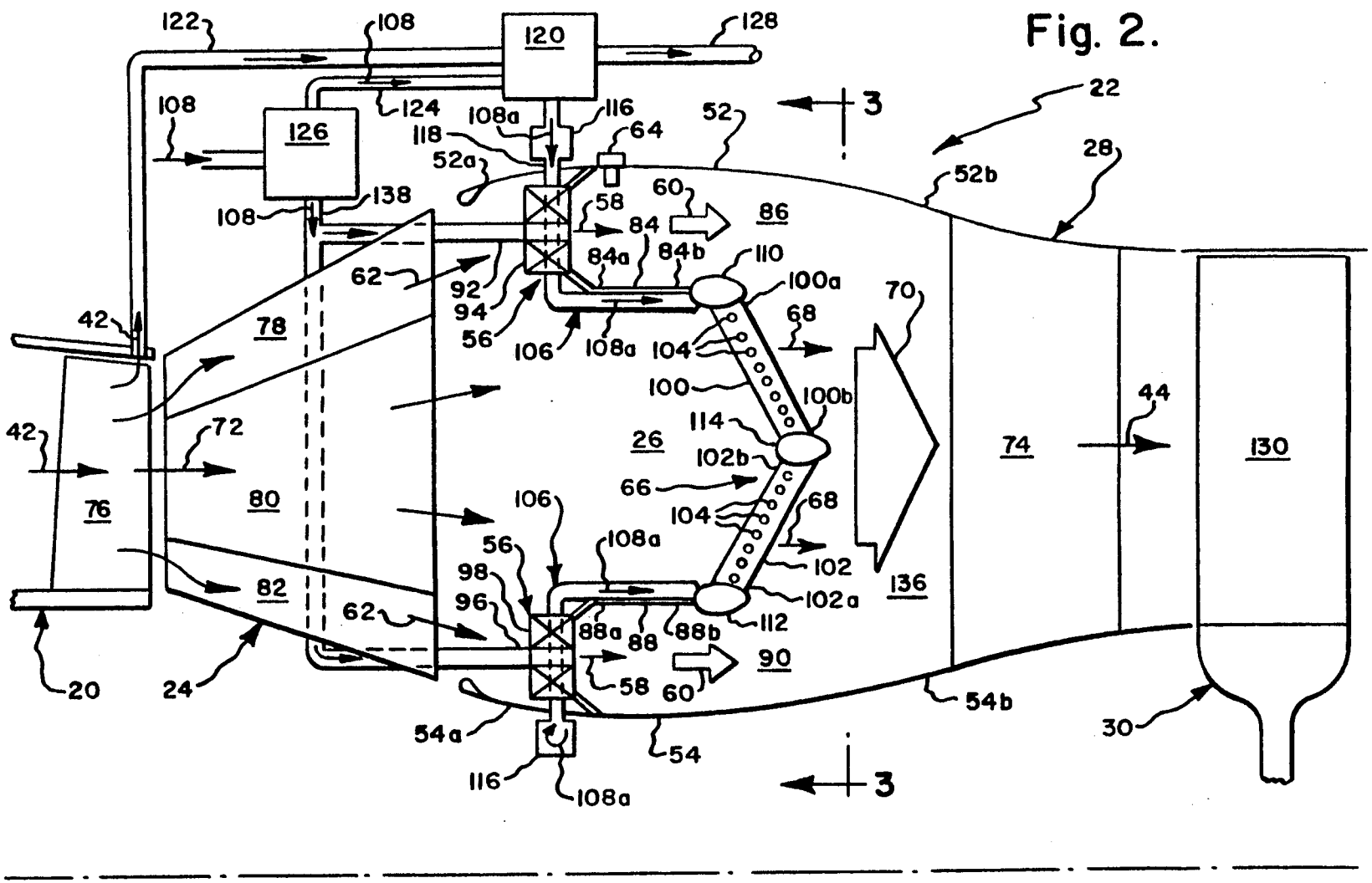
FIG. 2 is a schematic, sectional, representation of a combustion assembly of the engine illustrated in FIG. 1 in accordance with a preferred embodiment of the invention.

Illustrated in FIG. 1 is an augmented, turbofan gas turbine engine 10 for powering an aircraft during conventional modes of operation including for example, light-off, idle, takeoff, cruise and approach. The engine 10 is effective for powering aircraft at relatively high speed, in a range, for example, of Mach 2.2–2.7 at altitudes up to about 60,000 feet (18.3 kilometers). Disposed concentrically about a longitudinal centerline axis 12 of the engine in serial flow communication is a conventional inlet 14 for receiving ambient air 16, a conventional fan 18, and a conventional high pressure compressor (HPC) 20. Disposed in flow communication with the HPC 20 is a lean staged combustion assembly 22 in accordance with a preferred and exemplary embodiment of the present invention. The combustion assembly 22 includes a diffuser 24 in flow communication with the HPC 20 followed by a combustor 26 and a turbine nozzle 28.

Disposed downstream of and in flow communication with the turbine nozzle 28 is a conventional high pressure turbine (HPT) 30 for powering the HPC 20 through a conventional first shaft 32 extending therebetween. A conventional low pressure turbine (LPT) 34 is disposed downstream of and in flow communication with the HPT 30 for powering the fan 18 through a conventional second shaft 36 extending therebetween. A conventional bypass duct 38 surrounds the HPC 20, combustion assembly 22, HPT 30, and LPT 34 for channeling a portion of the ambient air 16 compressed in the fan 18 as bypass air 40.

A portion of the air 16 which is not bypassed, is channeled into the HPC 20 which generates relatively hot, compressed air 42 which is discharged from the HPC 20 into the diffuser 24. The compressed air 42 is mixed with fuel as further described hereinbelow and ignited in the combustor 26 for generating combustion gases 44 which are channeled through the HPT 30 and the LPT 34 and discharged into a conventional afterburner, or augmenter, 46 extending downstream from the LPT 34. The augmentor 46 is optional and may be incorporated in the engine 10 if required by the particular engine cycle.

In a dry mode of operation, the afterburner 46 is deactivated and the combustion gases 44 are simply channeled therethrough. In a wet, or activated mode of operation, additional fuel is mixed with the combustion gases 44 and the bypass air 40 in a conventional fuel injector/flameholder assembly 48 and ignited for generating additional thrust from the engine 10. The combustion gases 44 are discharged from the engine 10 through a conventional variable area exhaust nozzle 50 extending downstream from the afterburner 46.

Illustrated in more particularity in FIG. 2 is the combustion assembly 22 in accordance with a preferred and exemplary embodiment of the present invention. The assembly 22 includes an annular combustor outer liner 52 having an upstream end 52*a* and a downstream end 52*b*, and a radially inwardly spaced annular combustor inner liner 54 having an upstream end 54*a* and a downstream end 54*b*. The assembly 22 further includes means 56 for obtaining pilot stage combustion of a pilot fuel/air mixture 58 for generating pilot stage combustion gases 60 between the inner and outer liners 52 and 54 using a pilot portion 62 of the compressed air 42 channeled to the combustor 26. A conventional igniter, or plurality of igniters, 64 is disposed through the outer liner 52 for igniting the pilot fuel/air mixture 58.

The combustion assembly 22 further includes means 66 for obtaining main stage combustion of a lean fuel/air main mixture 68 for generating main stage combustion gases 70 between the inner and outer liners 52 and 54 using a main portion 72 of the compressed air 42 which is substantially greater than the pilot air portion 62. The main stage combustion means 66 is disposed downstream from the pilot stage combustion means 56 and in flow communication therewith. The turbine nozzle 28 is conventionally operatively joined to the combustor liner downstream ends 52*b* and 54*b* for allowing differential thermal expansion and contraction therewith, and includes a plurality of conventional, circumferentially spaced nozzle vanes 74 extending radially between the liner downstream ends 52*b* and 54*b*. In accordance with one feature of the present invention, the main stage combustion means 66 is close-coupled to the turbine nozzle 28 for obtaining relatively short combustion residence time of the main stage combustion gases 70 for reducing $NO_x$ emissions.

More specifically, the main stage combustion means 66 is positioned in the combustor 26 so that it is relatively close to the turbine nozzle 28 i.e., close-coupled, and therefore the duration of combustion of the main combustion gases 70 in the combustor 26 and generally upstream of the turbine nozzle 28 occurs in a residence time less than that of a conventional combustor-nozzle arrangement. Combustion residence time is the duration of the combustion process of the main combustion gases 70 within the combustor 26 primarily upstream from the turbine nozzle 28. Accordingly, the combustion gases 70 are channeled to the turbine nozzle 28 relatively quickly so that in the turbine nozzle 28 wherein they are conventionally accelerated by the nozzle vanes 74, the static temperature of the combustion gases 70 therein decreases relatively quickly effectively terminating the $NO_x$ formation reactions.

The combustion cycle of the combustor 26 is selected so that the nominal temperature of the combustion gases 70 in the combustor 26 are generally not greater than about 3000° F. (1649° C.) for reducing $NO_x$ emissions. It is conventionally known that $NO_x$ emissions occur in significant concentrations at combustion temperatures greater than about 3000° F. (1649° C.), and it is therefore desirable to limit the maximum combustion temperature to no greater than about that amount. However, in order to improve the overall operating efficiency of the engine 10, the combustion cycle is selected for obtaining relatively high combustor inlet temperatures and relatively high temperatures of the combustion gases 70 as compared to conventional cycles. The HPC 20 is sized for obtaining the compressed air 42 at temperatures of about 1250° F. (677° C.), which represents the combustor inlet temperature, and combustion exit temperatures of about 3000° F. (1649° C.) of the combustion gases 70.

Furthermore, as indicated above, $NO_x$ emissions are further reduced by the close-coupling of the main stage combustion means 66 to the turbine nozzle 28 for obtaining a relatively short residence time. Studies suggest that the present invention can be sized and configured for obtaining combustion residence times no greater than about 3 milliseconds which is generally less than half of the residence time of a conventional combustor-nozzle arrangement. The studies also indicate that residence times down to about 1 millisecond, and less, may be obtained for reducing $NO_x$ emissions to a level of about 5 grams per kilogram of fuel burned. Accordingly, by providing the combustion gases 70 relatively sooner to the nozzle 28, the nozzle 28 is effective for reducing the static temperature of the combustion gases 70 thus reducing, or eliminating, $NO_x$ emissions which would otherwise occur without a reduction in temperature.

Referring again to FIG. 2, further details of the combustion assembly 22 in accordance with the present invention are shown. The HPC 20 includes a plurality of circumferentially spaced conventional exit blades 76 as a last stage thereof. The diffuser 24 is disposed immediately upstream of the combustor 26 and comprises first, second, and third radially spaced diffuser channels 78, 80 and 82 respectively, which decrease the velocity of the compressed air 42 and increase the static pressure thereof.

The pilot stage combustion means 56 includes a pilot combustor first liner 84 having upstream and downstream ends 84*a* and 84*b*, which is spaced from the outer liner 52 to define a first pilot combustion zone 86. The means 56 also includes a pilot combustor second liner 88, having upstream and downstream ends 88*a* and 88*b*, respectively, which is spaced from the inner liner 54 to define a second pilot combustion zone 90. A plurality of circumferentially spaced conventional first fuel injectors 92 and corresponding first conventional air swirlers 94 extend between the first and outer liners 84 and 52 at the upstream ends thereof 84*a* and 52*a*, respectively. A plurality of circumferentially spaced conventional second fuel injectors 96 and corresponding conventional second air swirlers 98 extend between the second and inner liners 88 and 54, respectively, at the upstream ends 88*a* and 54*a*, respectively.

Referring to FIGS. 2–4, the main stage combustion means 66 is disposed between the downstream ends 84*b* and 88*b* of the first and second liners 84 and 88, respectively, and extends downstream therefrom. More specifically, the main stage combustion means 66 includes a first plurality of hollow, generally V-shaped first flameholders 100 having upstream and downstream ends 100*a* and 100*b*, respectively. A second plurality of circumferentially spaced, generally V-shaped hollow, second flameholders 102 are also included in the means 66 and have upstream and downstream ends 102*a* and 102*b* respectively. Each of the first and second flameholders 100 and 102 includes a plurality of longitudinally spaced fuel discharge holes 104 in flow communication with the interior thereof.

Means 106 for channeling fuel 108 into the flameholders 100 and 102 are provided. In one exemplary embodiment, the fuel channeling means 106 includes an annular first manifold 110 extending from the first liner downstream end 84*b* and disposed in flow communication with the upstream end 100*a* of the first flameholders 100. An annular second manifold 112 for receiving the fuel 108 extends from the second liner downstream end 88*b* and is disposed in flow communication with the upstream end 102*a* of the second flameholders 102. The first and second flameholders 100 and 102 are joined to each other at respective downstream ends 100*b* and 102*b* by an annular support ring 114. In an alternate embodiment, the ring 114 can comprise a manifold/-flameholder in flow communication with both the first and second flameholders 100 and 102.

The fuel channeling means 106 further includes two annular supply manifolds 116 which are concentric with the outer liner 52 and inner liner 54 and include conventional fuel conduits 118 which are connected in flow communication with the first and second manifolds 110 and 112. The means 106 may also comprise alternate forms including non-annular manifolds 116, and other arrangements as desired for providing fuel to the flameholders 100 and 102.

In accordance with a preferred embodiment of the invention, it is preferred that the fuel 108 be provided to the first and second manifolds 110 and 112 in vapor form, as opposed to either liquid or atomized form, although such other forms could be used in other embodiments of the invention. Accordingly, the fuel channeling means 106 further includes a conventional heat exchanger, or gasifier, 120 conventionally connected through a bleed air conduit 122 to the HPC 20 for receiving a portion of the relatively hot compressed air 42. The heat exchanger 120 is also conventionally connected in fluid communication through a supply conduit 124 to a conventional liquid fuel supply/control means 126 for receiving the fuel 108 in liquid form. The liquid fuel 108 is conventionally channeled in the heat exchanger 120 and heated therein by the compressed air 42 for vaporizing the fuel 108 (i.e., 108*a*) which is then conventionally channeled to the supply manifolds 116 connected thereto. The compressed air 42 which thus heats the fuel 108 in the heat exchanger 120 is thus reduced in temperature and discharged from the heat exchanger 120 through a discharge conduit 128 which may be used for conventionally cooling the HPT 30, for example HPT stage 1 blades 130 thereof.

Referring particularly to FIG. 4, in addition to FIGS. 2 and 3, each of the flameholders 100 and 102 has a V-shaped cross section including an apex 132 facing in an upstream direction and two inclined side surfaces 134, in each of which side surfaces 134 is disposed a respective plurality of the fuel holes 104 spaced in a longitudinal direction along each of the flameholders 100 and 102. The fuel holes 104 are preferably disposed in the side surfaces 134 facing in an upstream direction against the compressed air main portion 72 for providing improved mixing therewith and for reducing the possibility of auto-ignition of the main fuel/air mixture 68 formed by mixing of the vapor fuel 108*a* from the fuel holes 104 with the compressed air main portion 72 flowable thereover.

The region of the combustor 26 downstream of the first and second flameholders 100 and 102 defines a main combustion zone 136, as illustrated in FIG. 2, in which the main combustion gases 70 are generated and channeled. The first and second manifolds 110 and 112 are joined to the pilot first and second liners 84 and 88, respectively to define the main combustion zone 136 between the first and second pilot combustion zones 86 and 90 and the turbine nozzle 28. The first and second flameholders 100 and 102 are preferably inclined radially and inwardly, and outwardly, respectively, and in a downstream direction so that the first and second pilot combustion zones 86 and 90 are disposed in flow communication with the main combustion zone 136 for providing the pilot combustion gases 60 for igniting the main fuel/air mixture 68. Furthermore, the first and second flameholders 100 and 102 are so inclined to accommodate differential thermal expansion and contraction of the flameholders 100 and 102 by bending thereof.

In a preferred embodiment of the present invention, the diffuser 24 and the pilot means 56 are sized and configured so that the pilot stage combustion means 56 utilizes the compressed air pilot portion 62 which represents up to about ten percent (10%) of the total compressed air 42 provided to the combustor 26, and the main stage combustion means 66 utilizes the compressed air main portion 72 comprising the remainder, or ninety percent (90%) of the total compressed air 42. For example, the diffuser 24 may be configured so that the first and third diffuser channels 78 and 82 are inclined radially outwardly and inwardly, respectively, and discharge the pilot air portion 62 generally coextensively with and concentrically with the first and second air swirlers 94 and 98 of the pilot stage combustion means 56 so that each receives about five percent (5%) of the total compressed air 42. The second diffuser channel 80 is configured to provide a diverging channel for discharging the compressed air main portion 72 coextensively with and concentrically with both the first and second flameholders 100 and 102.

In operation, the liquid fuel supplying means 126 provides liquid fuel 108 through conventional conduits 138 to both the first and second fuel injectors 92 and 96 for mixing with the pilot air portion 62 for generating the pilot fuel/air mixtures 58. The pilot mixture 58 may be relatively rich since it utilizes a relatively small amount of the total compressed air 42 for providing acceptable light-off and stability of the combustion gases 60. During high power operation of the combustor 26 in the engine 10 for powering an aircraft at cruise, for example, the heat exchanger 120 provides vaporized fuel 108*a* to the first and second manifolds 110 and 112 which in turn channels the vaporized fuel 108*a* through the flameholders 100 and 102 for discharge through the discharge holes 104.

In accordance with a preferred embodiment, the equivalence ratio of the main fuel/air mixture 68 is up to about 0.75 and is preferably within a range of about 0.5 to about 0.75. The equivalence ratio is defined as the fuel/air ratio divided by stoichiometric fuel/air ratio of the main fuel/air mixture 68. Whereas a conventional gas turbine engine combustor would have an equivalence ratio of about 1.0 in its dome, the equivalence ratio up to about 0.75 for the preferred embodiment of the invention provides a relatively lean fuel/air mixture 68 for combustion in the main combustion zone 136. Since ninety percent or more of the compressed air 42 is utilized in the main stage combustion means 66, and since the main fuel/air mixture 68 is relatively lean, exhaust emissions, including $NO_x$ emissions can therefore be reduced.

Utilizing Jet A-type fuel, the combustion assembly 22 may be sized for reducing $NO_x$ emissions of the pilot and main stage combustion gases 60 and 70 discharged from the combustor 26 during the cruise power operation of the combustor to a level up to about five grams $NO_2$ per kilogram of Jet A-type fuel at an inlet temperature of the compressed air 42 channeled to the combustor 26 of about 1250° F. (677° C.), and for combustion temperatures of the gases 70 up to about 3000° F. (1649° C.). Fuel 108 in the form of vapor is preferred for enhanced fuel-air mixing to obtain generally uniform and relatively low equivalence ratios and for reducing the possibility of auto-ignition of the fuel/air mixture 68.

As illustrated in FIG. 4, the main combustion gases 70 form a recirculation zone 140 immediately downstream of the flameholders 100 and 102. The recirculation zones 140 provide for flame stability, and occur downstream of the flameholders 100 and 102. If fuel 108 in the form of liquid were discharged from the outlets 104, the possibility of auto-ignition would increase which could lead to combustion upstream of the flameholders 100 and 102 which is undesirable since damage to the flameholders 100 and 102 could result therefrom.

By utilizing the fuel 108 in the form of a vapor, the tendency for auto-ignition of the fuel is substantially reduced and, enhanced mixing of the vapor fuel 108*a* and the main air portion 72 results which provides for more effective combustion. Furthermore, by using the disclosed configuration of the flameholders 100 and 102 enhanced mixing of the fuel 108*a* and the main air portion 72 results. This creates a more uniform main fuel-air mixture 68, reducing the potential of local fuel rich zones, which allows for more complete combustion upstream of the nozzle 28 within the relatively short combustion residence times desired for reducing $NO_x$.

The pilot stage combustion means 56 may be utilized during all power operations of the engine 10 if desired, or alternatively, the means 56 may be selectively utilized solely for light-off and low power operation of the engine to initiate combustion and maintain flame stability. At relatively high power operation of the engine 10, for example, at over thirty percent of maximum power, the pilot stage combustion means 56 may be deactivated and the main stage combustion means 66 utilized solely. Similarly, the main stage combustion means 66 may be utilized during all power operations of the engine 10, although in the preferred embodiment it is activated solely for operation above idle. Of course, during operation of both the pilot stage and main stage combustion means 56 and 66, the pilot combustion gases 60 will necessarily mix with the main combustion gases 70 and form the combustion gases 44 discharged from the combustor 26. And, during operation of either the pilot combustion means 56 or mainstage combustion means 66, the combustion gases 44 are formed from the pilot gases 60 or main gases 70, respectively.

The combustor liners 52, 54, 84 and 88 are preferably non-metallic, such as conventional combustor ceramics or carbon-carbon, without conventional film cooling so that the compressed air 42 may be used primarily for combustion for increasing efficiency and so that quenching of the fuel-air mixtures adjacent to the liners is reduced for reducing exhaust emissions. However, conventional, cooled liners could be used in alternate embodiments.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention.

More specifically, and for example only, although the preferred embodiment includes both the first and second combustion zones 86 and 90, other embodiments of the invention can simply use a single pilot combustion zone.

Furthermore, the fuel channeling means 106 and the liquid fuel supplying means 126 could, alternatively, be configured for selectively providing different amounts of fuel to the first and second fuel injectors 92 and 96 and the first and second flameholders 100 and 102 for providing four independently controllable combustion zones downstream from those respective elements. This would allow the profile of the combustion gases 44 discharged from the combustor 26 to be tailored in four different zones. For example, such tailoring of the combustion gases 44 may be desired for improving efficiency of those gases 44 over the HPT stage 1 blades 130.

Furthermore although a particular type of flameholder 100, 102 has been disclosed other embodiments of flameholders may be utilized without departing from the true spirit of the present invention.

Although the heat exchanger 120 is provided for vaporizing the fuel 108 to the flameholders 100 and 102, other means for providing vaporized fuel 108*a* could be provided, and vaporized fuel 108*a* could also be provided to the fuel injectors 92 and 96 if desired. For example, the compressor bleed air channelled through the conduits 122 could be suitably mixed with the liquid fuel 108 to provide a vaporized fuel/air mixture which could be suitably channeled to the manifolds 110 and 112. In such an embodiment of the invention, the fuel-/air mixture would be channeled through the discharge holes 104 which would additionally mix with the compressed air main portion 72. Of course, the relative amounts of the mixed fuel and air would be adjusted to obtain the desired final fuel/air ratio and equivalence ratio.

Accordingly, what is desired to be secured by Letters Patent of the United States is the invention as defined and differentiated in the following claims.

We claim:

1. A lean staged combustion assembly comprising:

means for channeling compressed air including a pilot portion and a main portion;

a combustor including:

an annular combustor outer liner having an upstream end and a downstream end;

an annular combustor inner liner having an upstream end and a downstream end and spaced from said outer liner;

means for obtaining pilot stage combustion of a fuel-air pilot mixture for generating pilot stage combustion gases between said inner and outer liners using said pilot portion of compressed air channeled to said combustor by said channeling means, including:

a pilot combustor first liner having an upstream end and a downstream end and spaced from said outer liner to define a first pilot combustion zone;

a pilot combustor second liner having an upstream end and a downstream end and spaced from said inner liner to define a second pilot combustion zone;

a plurality of circumferentially spaced first fuel injectors and corresponding first air swirlers extending between said first and outer liners at said upstream ends thereof; and a plurality of circumferentially spaced second fuel injectors and corresponding second air swirlers extending between said second and inner liners at said upstream ends thereof;

means for obtaining main stage combustion of a lean fuel-air main mixture for generating main stage combustion gases between said inner and outer liners using said main portion of said compressed air channeled to said combustor by said channeling means, which main portion is greater than said pilot portion; and said main stage combustion means being disposed between said downstream ends of said first and second liners, and downstream from said pilot stage combustion means and in flow communication therewith; and a turbine nozzle joined to said combustor at said downstream end of said inner and outer liners and extending therebetween and downstream from said main stage combustion means.

2. A combustion assembly according to claim 1 wherein said main stage combustion means is disposed adjacent to said turbine nozzle for obtaining combustion residence times of said main stage combustion gases of no greater than about three milliseconds.

3. A combustion assembly according to claim 1 wherein said main stage combustion means effects an equivalence ratio defined as fuel/air ratio divided by stoichiometric fuel/air ratio of up to about 0.75 of said lean fuel/air main mixture.

4. A combustion assembly according to claim 3 wherein said equivalence ratio is within a range of about 0.5 to about 0.75.

5. A combustion assembly according to claim 4 wherein said main stage combustion means is disposed adjacent to said turbine nozzle for obtaining combustion residence times of said main stage combustion gases of no greater than about three milliseconds.

6. A combustion assembly according to claim 5 wherein:

said channeling means channels as said pilot portion up to about ten percent of a total compressed air provided to said combustor, and channels as said main portion a remainder of said total compressed air; and said pilot stage combustion means utilizes said compressed air pilot portion for generating said pilot stage combustion gases in each of said first and second pilot combustion zones, and said main stage combustion means utilizes said compressor air main portion for generating said main stage combustion gases.

7. A combustion assembly according to claim 6 wherein said combustor is sized for reducing $NO_x$ emissions of said pilot and main stage combustion gases discharged from said combustor during a cruise power operation of said combustor to a level up to about five grams $NO_2$ per kilogram of Jet A-type fuel at an inlet temperature of said compressed air channeled to said combustor of about 1250° F. (677° C.).

8. A combustion assembly according to claim 1 wherein said main stage combustion means comprises:

a plurality of circumferentially spaced hollow flameholders spaced from said pilot stage combustion means, each of said flameholders including a plurality of longitudinally spaced fuel holes; and means for channeling fuel into said flameholders for discharge from said flameholders through said fuel holes.

9. A combustion assembly according to claim 8 wherein said fuel channeling means channels vaporized fuel into said flameholders.

10. A combustion assembly according to claim 9 wherein said fuel channeling means includes a heat exchanger for receiving a portion of said compressed air and for receiving liquid fuel, said heat exchanger being effective for using said compressed air to vaporize said liquid fuel and channelling said vaporized fuel into said flameholders.

11. A combustion assembly according to claim 8 wherein each of said flameholders has a V-shaped cross section including an apex facing in an upstream direction and two inclined side surfaces, and wherein said plurality of fuel holes are disposed in both said side surfaces and face in an upstream direction.

12. A combustion assembly according to claim 11 wherein said fuel channeling means includes an annular first manifold for receiving fuel, and an annular second manifold for receiving fuel; and wherein said flameholders include a first plurality of first flameholders having upstream and downstream ends and joined at said upstream ends thereof in fluid communication with said first manifold, and a second plurality of second flameholders having upstream and downstream ends and joined at said upstream ends thereof in fluid communication with said second manifold; and said first and second flameholders are joined to each other at respective ones of said downstream ends thereof.

13. A combustion assembly according to claim 12 wherein said first and second flameholders are inclined radially inwardly and outwardly, respectively, and in a downstream direction.

14. A combustion assembly according to claim 12 wherein said first and second manifolds are joined to said pilot first and second liners, respectively, to define a main combustion zone between said first and second pilot combustion zones and said turbine nozzle.

15. A combustion assembly according to claim 14 wherein said main stage combustion means is disposed adjacent to said turbine nozzle for obtaining combustion residence times of said main stage combustion gases of no greater than about three milliseconds.

16. A combustion assembly according to claim 15 wherein said main stage combustion means effects an equivalence ratio defined as fuel/air ratio divided by stoichiometric fuel/air ratio of up to about 0.75 of said lean fuel/air main mixture.

17. A combustion assembly according to claim 16 wherein said equivalence ratio is within a range of about 0.5 to about 0.75.

18. A combustion assembly according to claim 17 wherein:

said channeling means channels as said pilot portion up to about ten percent of a total compressed air provided to said combustor, and channels as said main portion a remainder of said total compressed air; and said pilot stage combustion means utilizes said compressed air pilot portion for generating said pilot stage combustion gases in each of said first and second pilot combustion zones, and said main stage combustion means utilizes said compressor air main portion for generating said main stage combustion gases.

19. A combustion assembly according to claim 18 further including an annular diffuser disposed upstream of said combustor and comprising first, second, and third radially spaced diffuser channels, said first and third channels being aligned in flow communication with said first and second air swirlers, respectively, and said second diffuser channel being disposd radially between said first and third diffuser channels and being aligned in flow communication with said main stage combustion means.

* * * * *